US006557440B1

(12) United States Patent
Presa Eguren

(10) Patent No.: US 6,557,440 B1
(45) Date of Patent: May 6, 2003

(54) SIMPLIFIED PORTABLE CORK-SCREW

(76) Inventor: Jacinto Presa Eguren, Avenida de Atenas 75, E-28230 Las Rozas (ES)

( * ) Notice: Subject to any disclaimer, the term of this patent is extended or adjusted under 35 U.S.C. 154(b) by 0 days.

(21) Appl. No.: 09/623,244

(22) PCT Filed: Dec. 29, 1999

(86) PCT No.: PCT/ES99/00410

§ 371 (c)(1),
(2), (4) Date: Nov. 24, 2000

(87) PCT Pub. No.: WO00/40500

PCT Pub. Date: Jul. 13, 2000

(30) Foreign Application Priority Data

Dec. 31, 1998 (ES) ..... 9803279 U

(51) Int. Cl.[7] ..... B67B 7/04
(52) U.S. Cl. ..... 81/3.47; 81/3.09
(58) Field of Search ..... 81/3.09, 3.35, 81/3.37, 3.47, 3.48, 3.49, 3.57

(56) References Cited

U.S. PATENT DOCUMENTS 501,468 A * 7/1893 Puddefoot ..... 81/3.35
1,273,026 A * 7/1918 Brown ..... 81/3.35

FOREIGN PATENT DOCUMENTS

ES 1020637 U 7/1992
ES 1035671 U 5/1997

* cited by examiner

*Primary Examiner*—Joseph J. Hail, III
*Assistant Examiner*—David B. Thomas
(74) *Attorney, Agent, or Firm*—Michael J. Striker

(57) ABSTRACT

The invention relates to a portable cork-screw provided with conventional spiral extraction means (1) which is hinged by means of a pin (4) to a planar part (2) constitutive of the cork screw body, in a position displaced towards one of its ends, the part being provided with two recess (5, 6) in opposite edges; one recess (5) is proximate to the articulation of the spiral (1); a second part (3) is hinged to the end of the part (2) which is closer to the pin (4); the second part (3) is formed by a first cylindrical portion **(3*a*) which is hinged at a first end to the part (2) by means of a pin (7) and is rotationally joined by its other end to a second cylindrical portion (3*a*); the final section of said second portion is lowered to form a first curved portion having the shape of a tile; said first portion (3*a*) has a longitudinal opening which is slightly longer than the distance existing between the recess (5) and the hinge pin (7) of the second part (3)**.

5 Claims, 3 Drawing Sheets

SIMPLIFIED PORTABLE CORK-SCREW

BACKGROUND OF THE INVENTION

The present invention refers to a simplified portable cork-screw which in a folded position occupies a minimum space facilitating its easy transport by the user and which contributes new basic features and important advantages with respect to other articles known and used in the current state of the art.

More specifically, the invention proposes the development of a cork-screw device, which in its more general nature, permits a practical use by the user which is fast and simple for which it has been composed from two parts articulated to each other, susceptible of mutual folding and shaped with complementary profile areas, permitting their relative adaptation in the folded cork-screw position. One of said parts provides two different support points, which may be taken advantage of in the cork removal operation.

The field to which the invention belongs is included in the industry dedicated to the manufacture of different household, promotion, gift or equivalent items, with both domestic and industrial applications.

A wide variety of cork-screw devices are known in the market, with domestic and/or domestic applications, with very varied shapes and complexity, depending on the specific application foreseen for such a device.

When it is a portable cork-screw, it is obvious that such a device should fulfil, as far as possible, determined requirements, such as occupying very little space, being light and having a simple and comfortable handling for the user, otherwise, this type of article would lose most of its purpose and attraction.

SUMMARY OF THE INVENTION

Considering the above, the invention has developed a cork-screw device combining the properties of being simple and practical, easy to transport and use. For this reason, the cork-screw has, besides a spiral with conventional features that may be nailed into the cork to be removed by means of the application of the corresponding manual rotation movement, two appropriately shaped parts, one of which is joined to said spiral, consisting of the pulling part; it has been shaped as a planar part, provided with an extensive recess along one of its edges to receive a portion of the other part in the folded cork-screw position and a reduction of larger dimensions along the opposite edge, facilitating the grip thereof, by the user. The other piece, consists of two parts coupled to each other with the possibility of relative rotation, so that one of these parts, cylindrically shaped, is the one which provides the articulation of the first mentioned part, and the other part, or extreme area, has been reduced in most of its diameter to have only an arched longitudinal portion, like a "tile", by means of which a step is provided consisting of a first support and forming the free end of said longitudinal portion, the second support point in the cork removal operation, as will be explained below in relation to the drawings.

BRIEF DESCRIPTION OF THE DRAWINGS

These and other features and advantages of the invention may be clearly understood as from the following detailed description of a preferred embodiment, given as an illustrative and non-limiting example, with reference to the attached drawings, in which.

DESCRIPTION OF THE PREFERRED EMBODIMENT

As mentioned above, the detailed description of the preferred embodiment of the invention is going to be made on the basis of the figures above, in which the same references have been used to indicate equal or similar parts.

Figure 1:
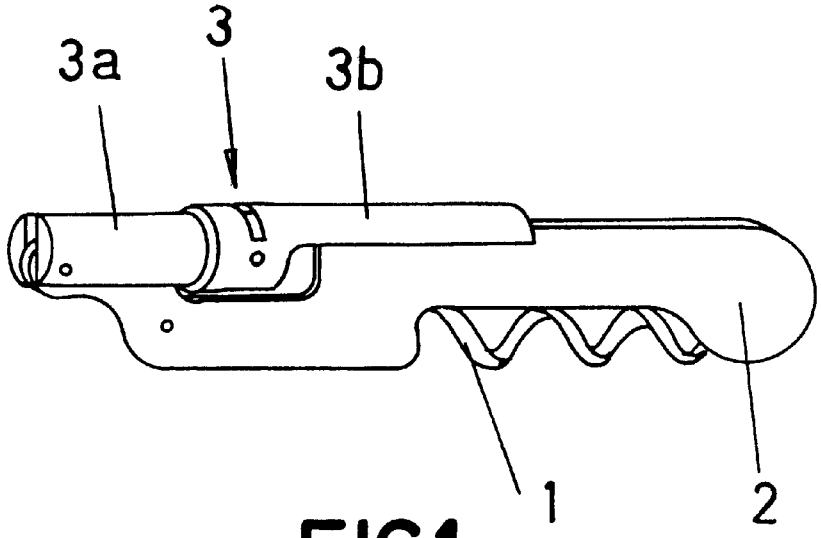
FIG. 1 shows a schematic perspective view of a cork-screw constructed according to this invention in its folded position.
Figure 2:
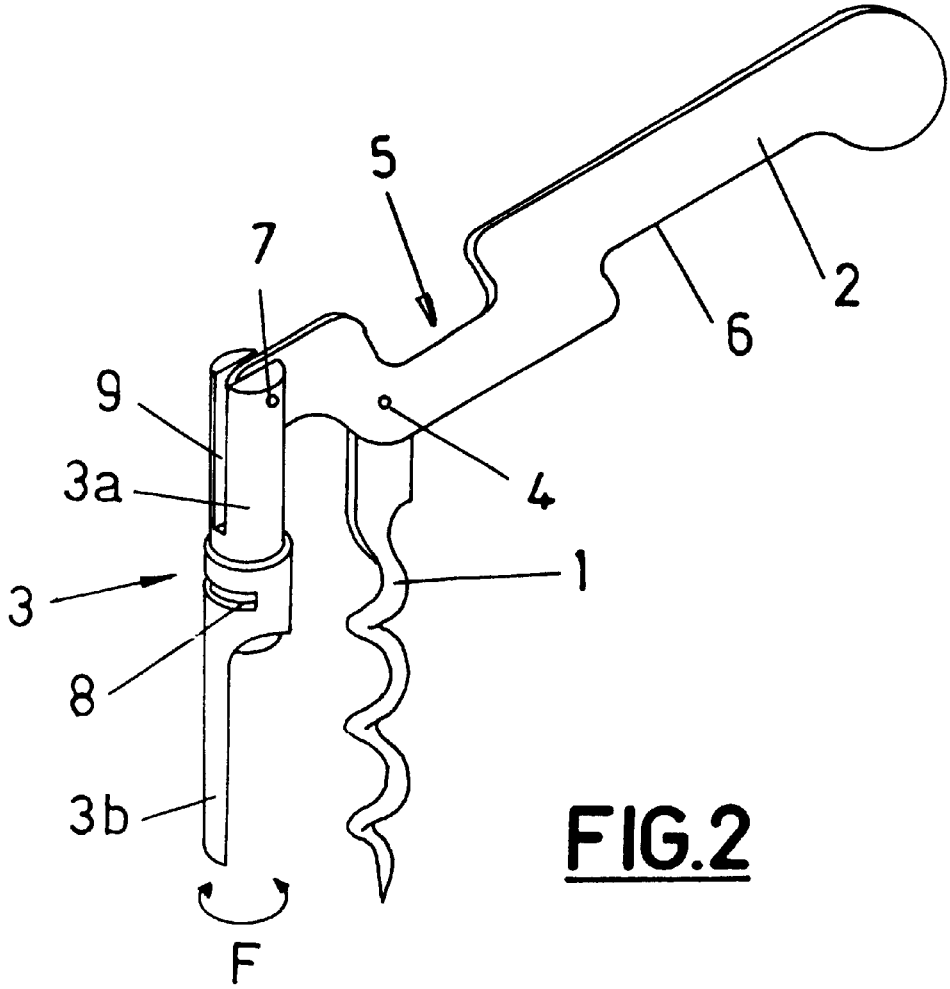
FIG. 2 shows a perspective view of the cork-screw of FIG. 1 in the unfolded position.

Referring to FIGS. 1 and 2, it may be seen that the cork-screw of the invention appears to be represented, respectively, in the folded and open positions. Said cork-screw device consists of a conventional spiral (1) articulated by the corresponding end to a generally planar part (2), with the use of a pin (4) in a position which is much closer to one of the ends of the part (2) than the other, with the purpose of applying a relevant lever arm in the cork removal operation. Said part (2) consists of the handle or pulling component, having a recess portion (5) along one of its edges, whilst along the opposite edge there is a recess (6).

In the end next to the articulation position (4) a second part has been joined, generally marked with number (3), in the position of the hinge pin (7) which consists of two parts (3*a*, 3*b*), generally both cylindrical, linked to each other with the possibility of a relative axial rotation, such that one part (3*b*) has a transverse opening (8) where a spigot (not marked) belonging to the other part (3*a*), by means of which said relative rotation is possible and moreover constitutes a relevant retention means in the longitudinal direction of said part (3). The mentioned first part (3*a*) of said second part (3) has a notch (9), extended to almost all its length, such that the longitudinal dimension is equal or slightly greater than the distance represented by the edge section comprised between the recess (5) of part (2) and the adjacent end thereof. On the other hand, part (3*b*) of the part (3) has an initial cylindrical section which then is continued with a portion of arched wall, like a "tile", with the formation of a step, resulting in the removal of a large proportion of the cylindrical body of said part. Accordingly, the dimensions of the recess (5) have been calculated such that they permit the housing of the cylindrical portion of the part (3), existing between the end of the notch (9) and the beginning of the "tile"portion of part (3*b*). In this way, a fold is produced occupying a minimum space, facilitating the comfortable transport of the cork-screw. This situation is shown in FIG. 1, where the lower part (3*b*) of the second part (3) is rotated approximately 180°, as indicated by the arrow (F), with respect to the position of FIG. 2, such that the mentioned recess (5) of the outside edge of part (2) permits that the "tile" shaped section of the mentioned part (3*b*), may be directly arranged over the edge of this part (2).

Figure 3:
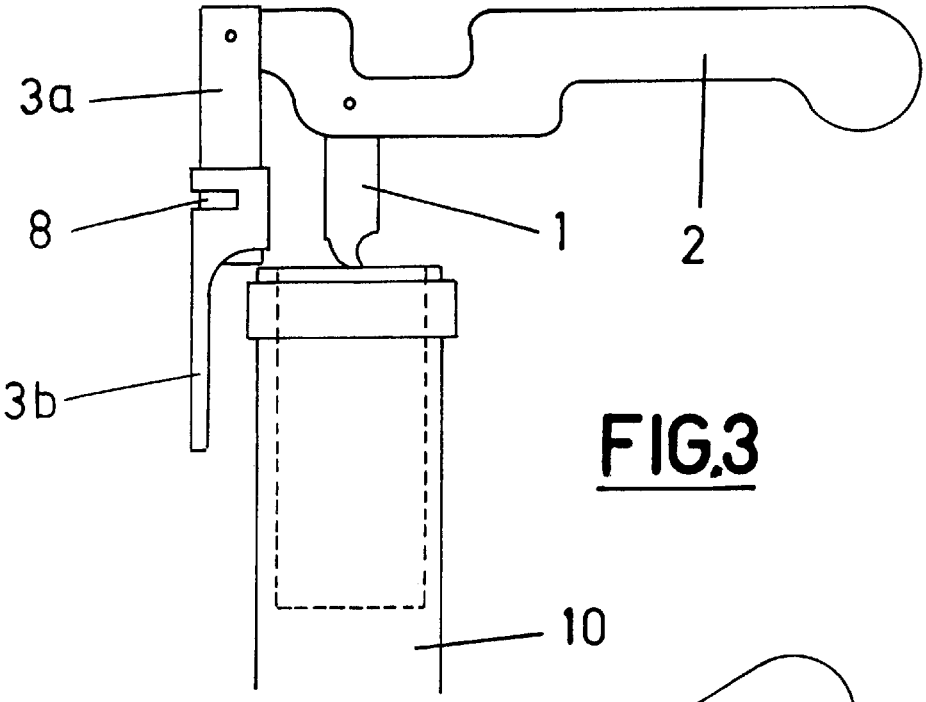
FIG. 3 is a schematic elevated view of the corkscrew of the invention coupled to a bottle neck to remove the cork from the same, at the start of the removal operation and, FIGS. 4 to 6 show a sequential representation of the cork removal operation from a bottle using the cork-screw of FIGS. 1 and 2.

When the cork-screw device of the invention is applied to remove a cork from a bottle, it is necessary to carry out a series of actions, according to a determined sequence, all the former resulting in a simple and fast embodiment. These successive phases are graphically represented in FIGS. 3 to 6. For its execution, once the cork-screw has been opened as appears in FIG. 2, it is necessary to apply the spiral (1) to the cork (11) of the bottle, rotating the cork-screw with one hand, from the handle part (2), whilst the bottle is held by the neck (10) with the other hand. Once the spiral has been introduced, with the lower part (3*b*) of the part (3) accordingly rotated, the step provided by the recessed area of said part (3*b*) is placed over the upper edge of the bottle neck as indicated in FIG. 3. Under these conditions, using the same hand that holds the bottle to also simultaneously hold part (3*b*) in its support over the bottle neck (10), the first hand may be used to pull in an ascending direction over the part of the handle, the lever arm provided due to the pulling application distance collaborating with this effort, until the point of support over bottle neck. The latter removes the cork in the first proportion shown in FIG. 4.

Figure 4:
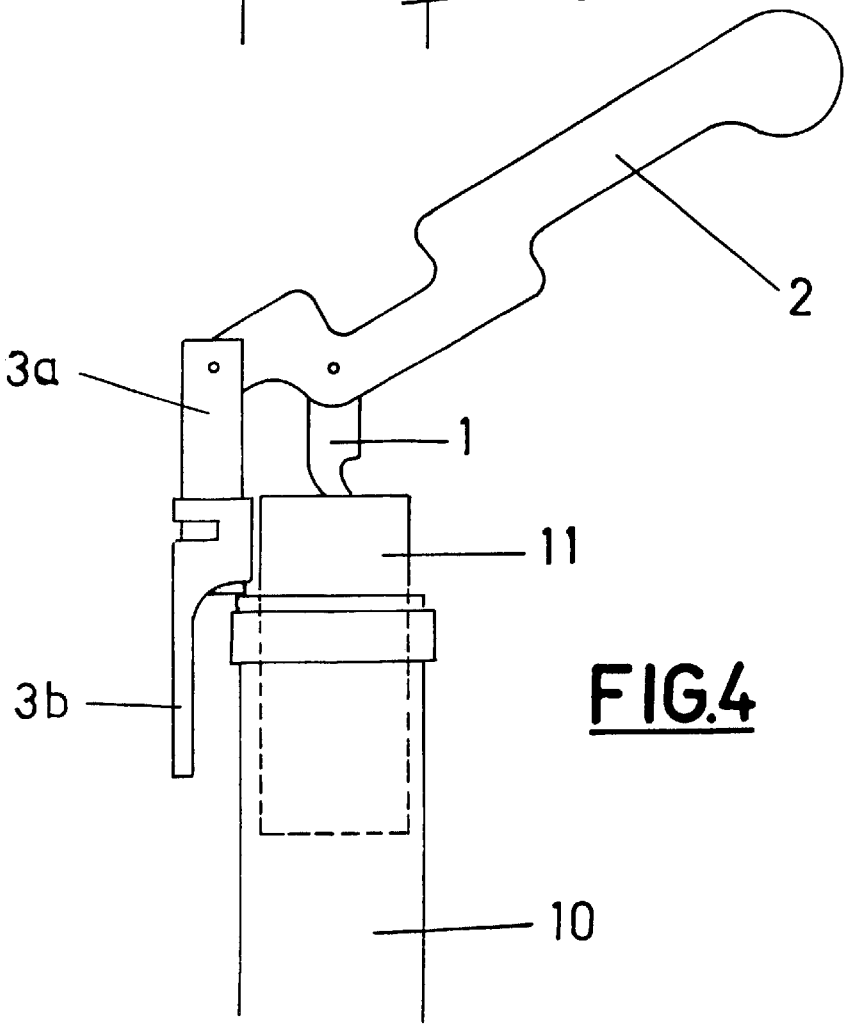
Figure 5:
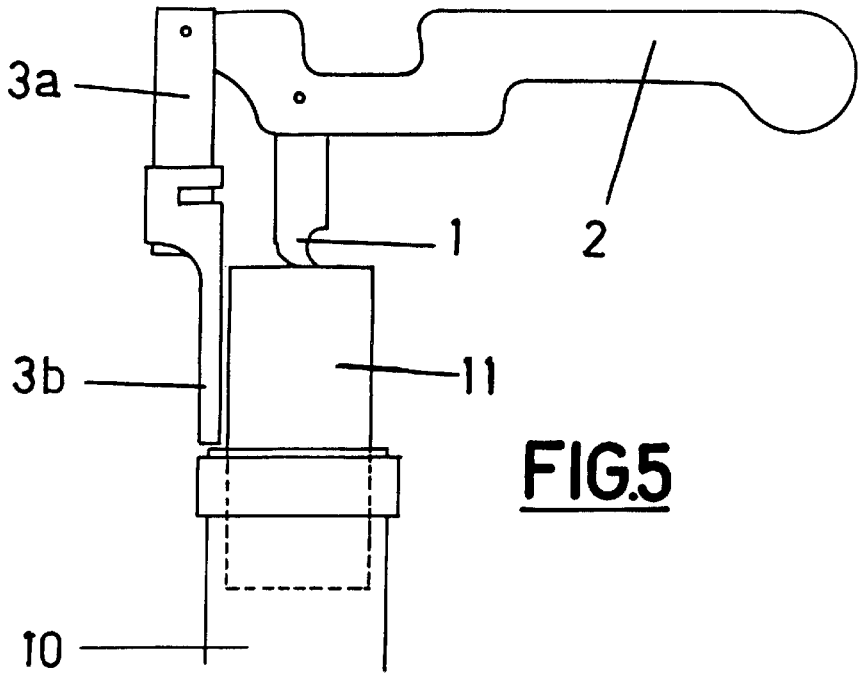
Figure 6:
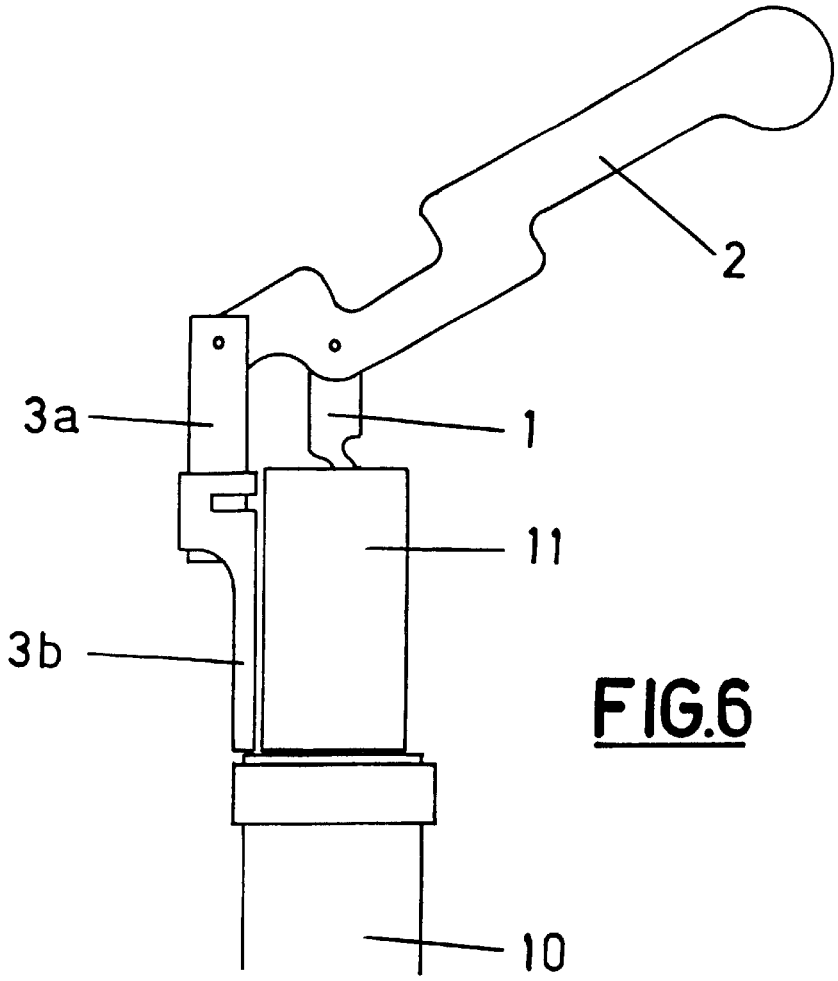

After this first phase, and with the purpose of providing a greater run to the removing operation, the part (2) of the handle is made to descend, such that the support part (3) may be raised, such that after rotating 180° the lower part (3*b*) of said part (3) with respect to the position of FIG. 4, the lower end of this part (3*b*) is arranged over the upper part of the bottle neck (10) as indicated in FIG. 5, such that by holding part (3*b*) again in this position with the same hand as that holding the bottle and applying a new pulling force upwards, over the part (2) of the handle, the rest of the cork (11) still remaining inside the bottle neck (10) may be removed, as shown in FIG. 6, or at least leaving said cork in a position such that it may be finally separated from the bottle with a slight manual pulling.

From the above, it may be understood that removal of the cork (11) is made in two successive stages, with the suitable positioning of part (3*b*) of the support part to apply the lever effect desired for such a purpose.

It is not considered necessary to extend the contents of this specification more for a skilled person to understand its scope and the advantages derived from the invention, as well as to develop and implement the purpose thereof.

However, it should be understood that the invention has been described according to a preferred embodiment thereof, such that it may be modified without representing any alteration whatsoever of the basis of said invention, such modifications being especially made to the shape, size and/or manufacturing materials.

What is claimed is:

1. A cork-screw, comprising a first part; a second part which is turnably connected with said first part; a spiral component nailable into a cork and joined to said first part, said first part being formed as a manual pulling application handle having a substantially flat shape, and being provided with a recess along an edge of said first part, said second part being substantially cylindrical and having two portions rotatable relative to one another over an angle of substantially 180°, said first portion having a notch extending from a point of an articulation between said first and second parts, and said second portion having a recess forming an arched wall.

2. A cork-screw as defined in claim 1, and further comprising a pin which connects said first part and said second part in said articulation point.

3. A cork-screw as defined in claim 1, wherein said notch of said first portion has a length which is at least equal to a portion of an edge between said recess of said first part and said articulation point.

4. A cork-screw as defined in claim 3, wherein said recess has a length which is at least equal to a distance between an end of said notch and a starting step of said arched wall, so that in a folded position of the cork-screw said portion of an edge is housed in said notch, and a portion of said second part between said notch and said starting step of said arched wall is introduced into said recess so as to occupy a minimum space.

5. A cork-screw as defined in claim 1, wherein said second part has two support points to remove the cork in two stages, said support points being formed by a step of a starting point of said arched wall for a first one of said stages and by a free end of said second portion for a second one of said stages.

* * * * *